US008120565B2

(12) United States Patent
Nishimura et al.

(10) Patent No.: US 8,120,565 B2
(45) Date of Patent: Feb. 21, 2012

(54) METHOD AND APPARATUS TO ENHANCE CONTRAST IN ELECTRO-OPTICAL DISPLAY DEVICES

(75) Inventors: Ken A. Nishimura, Fremont, CA (US); Charles D. Hoke, Menlo Park, CA (US); Thomas A. Knotts, Palo Alto, CA (US)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 2584 days.

(21) Appl. No.: 10/771,738

(22) Filed: Feb. 4, 2004

(65) Prior Publication Data

US 2005/0168430 A1 Aug. 4, 2005

(51) Int. Cl.
*G09G 3/36* (2006.01)

(52) U.S. Cl. ..... 345/96; 345/79; 345/209

(58) Field of Classification Search ..... 345/208–210, 345/53, 94–97

See application file for complete search history.

(56) References Cited

U.S. PATENT DOCUMENTS

| | | | | |
|---|---|---|---|---|
| 6,064,358 | A * | 5/2000 | Kitajima et al. | 345/88 |
| 6,493,867 | B1 | 12/2002 | Mei et al. | |
| 6,537,738 | B1 | 3/2003 | Mei et al. | |
| 6,677,925 | B1 * | 1/2004 | Kawaguchi et al. | 345/98 |
| 2002/0054266 | A1 | 5/2002 | Nishimura | |
| 2002/0163859 | A1 | 11/2002 | Brewer et al. | |
| 2003/0103024 | A1 | 6/2003 | Landolt et al. | |

* cited by examiner

*Primary Examiner* — Seokyun Moon

(57) ABSTRACT

Display contrast in electro-optical display devices is improved using a drive circuit including pixel drive circuits and a common drive circuit. The pixel drive circuits are connected to pixel electrodes of the display device, and are operable to generate respective pixel drive signals that alternate between a first high voltage and a first low voltage differing in voltage by less than or equal to a process-limited maximum. The common drive circuit is connected to a common electrode of the display device, and is operable to generate a common drive signal alternating between a second high voltage and a second low voltage differing in voltage by more than the process-limited maximum. The common drive signal is asymmetrically bipolar with respect to the first low voltage of the pixel drive signal.

18 Claims, 4 Drawing Sheets

METHOD AND APPARATUS TO ENHANCE CONTRAST IN ELECTRO-OPTICAL DISPLAY DEVICES

BACKGROUND OF THE INVENTION

1. Technical Field of the Invention

The present invention relates generally to electro-optical display devices, and in particular to driving electro-optical display devices.

2. Description of Related Art

Traditional active-matrix liquid crystal displays, such as those used in laptop computers, are manufactured by disposing liquid crystal material between a substrate and a glass cover. Individual electro-optical elements defining pixels of an image are created by patterning thin film transistors (TFTs) on the glass cover with a transparent conductive material, commonly indium tin oxide (ITO). To address a particular pixel, the proper row of the matrix is switched on and a charge is sent down the appropriate column of the matrix. A capacitor at the addressed pixel location holds the received charge until the next refresh cycle. However, the fundamental drive signal to set the state of each individual pixel is typically generated externally and provided to the individual pixels through matrix interconnections, which limits the pixel density of active-matrix LCDs.

A more recently developed type of LCD that permits a higher density of pixels than active-matrix LCDs is a liquid crystal on silicon (LCOS) microdisplay. In an LCOS microdisplay, the substrate is an active silicon integrated circuit on which individually controllable electro-optical elements are formed that define pixels of an image. Contained within the silicon substrate is the electronic circuitry used to drive each pixel. Thus, drive signals for the pixels within LCOS microdisplays are generated internally, thereby allowing more pixels per area than active-matrix LCDs. However, the drive voltage in LCOS microdisplays is limited by the breakdown voltage (i.e., the maximum voltage that can be produced and sustained) of the integrated circuit.

Modern integrated circuit processes are utilizing smaller and smaller feature sizes (e.g., 180 nm or smaller), which results in the production of smaller, faster and more power-efficient circuits. Smaller feature size translates into smaller and more densely packed pixels. However, as the feature size becomes smaller, the breakdown voltage decreases. For example, a typical 350 nm complementary metal oxide semiconductor (CMOS) circuit has a breakdown voltage of 3.3V. Smaller electronic components, such as a 180 nm CMOS transistor, typically have a breakdown voltage of only 1.8V.

An important characteristic of LCDs is the display contrast produced by the LCD. The display contrast refers generally to the difference between the optical response of an OFF pixel and the optical response of an ON pixel. To produce the highest possible display contrast, most liquid crystal material manufacturers recommend a drive voltage of 5V. However, when using a CMOS drive circuit containing 350 nm or smaller transistors within an electro-optical display device, such as an LCOS microdisplay, the drive voltage is typically limited to 3.3V or lower, which results in a poor display contrast. Therefore, what is needed is a mechanism for driving an electro-optical display device to increase the display contrast.

SUMMARY OF THE INVENTION

Embodiments of the present invention provide a drive circuit for driving an electro-optical display device. The display device includes a layer of electro-optical material disposed between a common electrode and an array of pixel electrodes. Pixel drive circuits connected to each of the pixel electrodes are operable to generate respective pixel drive signals that alternate between a first high voltage and a first low voltage differing in voltage by less than or equal to a process-limited maximum. A common drive circuit connected to the common electrode is operable to generate a common drive signal alternating between a second high voltage and a second low voltage differing in voltage by more than the process-limited maximum. The common drive signal is asymmetrically bipolar with respect to the first low voltage.

In one embodiment, the process-limited maximum is the breakdown voltage of the pixel drive circuits. The first low voltage and the second low voltage differ in voltage by less than or equal to a threshold voltage at which an electro-optical response is produced by the electro-optical material, and the first high voltage and the second high voltage differ in voltage by less than or equal to the threshold voltage. Thus, in one extreme where the pixel drive signal is at the first low voltage and the common drive signal is at the second low voltage, a negligible electro-optical response of the electro-optical element is produced.

In one configuration embodiment, the common drive circuit is located on a substrate of the display device that includes the array of pixel electrodes and the pixel drive circuits. The pixel drive circuits underlie their respective pixel electrodes on the substrate. In another configuration embodiment, the common drive circuit is located external to the substrate, and a timing circuit on the substrate controls the timing of the common drive signal generated by the common drive circuit.

Other embodiments of the present invention provide a method for driving an electro-optical display device that includes a layer of electro-optical material disposed between a common electrode and an array of pixel electrodes. Each of the pixel electrodes are driven with respective pixel drive signals that alternate between a first high voltage and a first low voltage differing in voltage by less than or equal to a process-limited maximum. The common electrode is driven with a common drive signal alternating between a second high voltage and a second low voltage differing in voltage by more than the process-limited maximum. The common drive signal is asymmetrically bipolar with respect to the first low voltage.

By forming a common drive signal that alternates between voltages that differ in voltage by more than the process-limited maximum, the display device can be driven over a higher voltage range that creates increased display contrast. In addition, spurious electro-optical responses are prevented by limiting the amount over and under the process-limited maximum to below a threshold voltage at which an electro-optical response is produced. Furthermore, the invention provides embodiments with other features and advantages in addition to or in lieu of those discussed above. Many of these features and advantages are apparent from the description below and with reference to the following drawings.

BRIEF DESCRIPTION OF THE DRAWINGS

The disclosed invention will be described with reference to the accompanying drawings, which shown sample embodiments of the invention and which are incorporated in the specification hereof by reference, wherein.

DETAILED DESCRIPTION OF EXEMPLARY EMBODIMENTS

Figure 1:
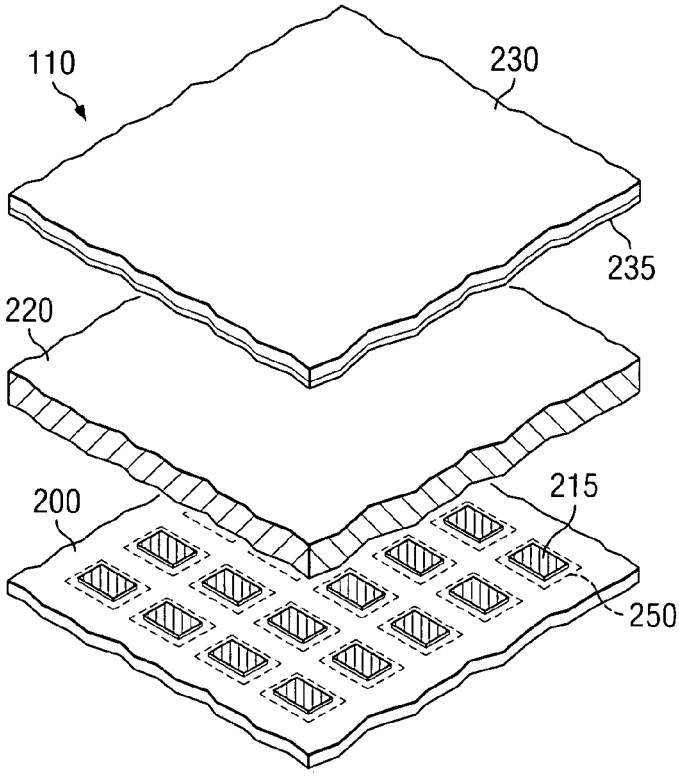
FIG. 1 is an exploded view of an electro-optical display device.

FIG. 1 is an exploded view of a portion of an exemplary electro-optical display device 110 with electro-optical elements that define pixels of an image. The electro-optical elements shown in FIG. 1 are reflective electro-optical elements. However, it should be understood that in other embodiments, transmissive electro-optical elements can be used.

The electro-optical display 110 shown in FIG. 1 includes a substrate 200 on which pixel electrodes 215 are located. The pixel electrodes 215 can be arranged in an array of rows and columns or in a nonorthogonal pattern. Within the substrate 200 below each pixel electrode 215 is located a pixel drive circuit 250 connected to drive the overlying pixel electrode 215. Disposed above the substrate 200 is a transparent glass 230 coated with a layer 235 of transparent electrically conductive material, such as indium tin oxide (ITO). The ITO layer 235 is the common electrode of the electro-optical display device 110, and is driven by a common drive circuit (not shown). Encapsulated between the substrate 200 and the glass 230 is a layer 220 of an electro-optical material, such as a liquid crystal material, that reacts in response to electric fields established between the common electrode 235 and pixel electrodes 215.

Figure 2:
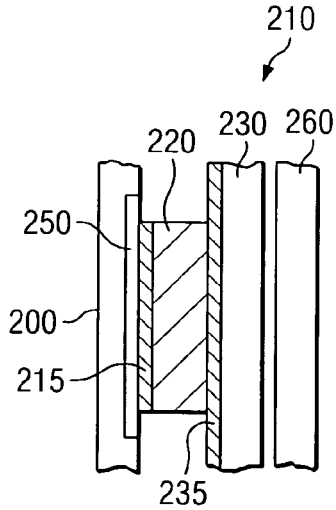
FIG. 2 is a cross-sectional view of an electro-optical element.

FIG. 2 is a cross-sectional view of an electro-optical element 210 of the display device 110. As shown in FIG. 2, the pixel electrode 215 in combination with the liquid crystal material 220, common electrode 235, associated pixel drive circuit 250 and polarizer 260 form an electro-optical element 210 that defines a pixel of an image displayed or projected by the display device. It should be understood that polarizer 260 includes one or more polarizers, as known in the art. Depending on the voltages applied between the pixel electrode 215 and common electrode 235, an electro-optical response of the electro-optical material 220 is produced that causes the pixel to appear light or dark.

An exemplary method for driving an electro-optical element 210 includes generating and applying a first periodic drive signal that toggles between a first voltage and a second voltage to the common electrode 235 and applying a second periodic drive signal that toggles between the same first voltage and second voltage to the pixel electrode 215. The combination of the two drive signals applies a differential drive voltage (DDV) across the electro-optical element 210 that produces an electro-optical response by the electro-optical element 210. The net RMS electric field within each electro-optical element 210 is determined by the relative phase between the drive signals applied to the common electrode 235 and the pixel electrodes 210. In one extreme, both drive signals are in-phase, and the DDV, net electric field and electro-optical response are zero. In the other extreme, the two drive signals are in antiphase, and the DDV, net electric field and electro-optical response are at a maximum. The resulting electric field in the antiphase extreme has an RMS value proportional to the difference between the first and second voltages. It should be noted that the magnitude of the electric field contained within the electro-optical element 210 is given by the applied DDV divided by the thickness of the liquid crystal material 220. While the electric field is inversely proportional to the thickness of the liquid crystal material 220, the integrated electro-optical effect is proportional to the thickness. Hence, the thickness contribution cancels, and assumed herein, to first order, only the applied DDV is considered in determining the net electro-optical response of the electro-optical element 210.

In another embodiment, the pixel electrodes 215 are driven with voltages that create a partial reaction of the liquid crystal material 220 so that the electro-optical element 210 is in a non-binary state (i.e., not fully ON or OFF) to produce a "gray scale" reflection. For example, a partial reaction of the liquid crystal material 220 is typically produced by applying drive signals on the pixel electrode 215 and common electrode 235 that are not fully in phase or in antiphase, thereby creating a duty cycle between zero and 100 percent. An example of a drive circuit configuration that produces a "gray scale" reflection is described in co-pending and commonly assigned published U.S. Patent Application 2003/0103024, which is incorporated herein by reference.

Figure 3A:
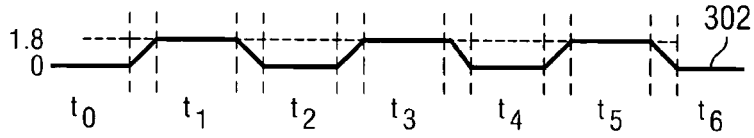
FIGS. 3A-3C is a graph of an exemplary voltage-to-electro-optical response curve for driving an electro-optical element.
Figure 3B:
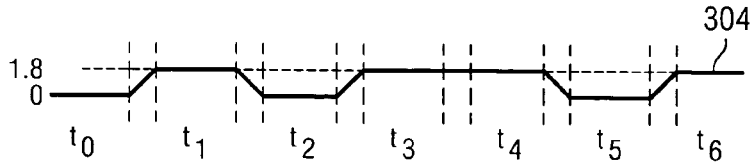
Figure 3C:
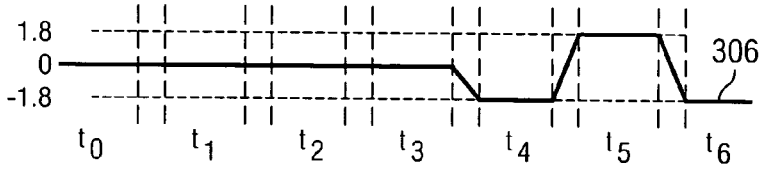

FIGS. 3A-3C are interrelated graphs illustrating a conventional drive method for an electro-optical element, such as that shown in FIG. 2, fabricated using a process that allows a maximum drive signal amplitude of 1.8V. The drive signal levels shown are consistent with those typically produced by conventional drive circuits of a LCOS microdisplay. FIG. 3A shows an exemplary common drive signal 302 that is applied to the common electrode of an electro-optical element. The common drive signal 302 ranges from a low voltage level of 0V to a high voltage level of 1.8V and is substantially periodic. As shown, the common drive signal 302 transitions between time intervals $t_0$ and $t_1$ from a low voltage level to a high voltage level, and further transitions from the high voltage level to the low voltage level between time intervals $t_1$ and $t_2$, respectively. The common drive signal 302 continues cycling thereafter.

FIG. 3B shows an exemplary pixel drive signal 304 that is applied to the pixel electrode of the electro-optical element. The pixel drive signal 304 ranges from a low voltage level of 0V to a high voltage level of 1.8V. As shown, the pixel drive signal 304 transitions between time intervals $t_2$ and $t_3$ from a low voltage level to a high voltage level, maintains the high voltage level between time intervals $t_3$ and $t_4$, and further transitions from the high voltage level to the low voltage level between time intervals $t_4$ and $t_5$, respectively. The pixel drive signal 304 and the common drive signal 302 collectively create a DDV that is applied between the common and pixel electrodes to create an electric field for selectively turning on and off the electro-optical element.

FIG. 3C shows the differential drive signal 306 created by the voltage differential between the common drive signal 302 and the pixel drive signal 304. As shown in FIG. 3C, over time intervals $t_0$-$t_3$, the DDV level of the differential drive signal 306 is 0V due to the common drive signal 302 and the pixel drive signal 304 being in phase and having the same voltage levels. At time interval $t_4$, the pixel drive signal 304 remains high while the common drive signal 302 transitions to a low voltage level. Therefore, the DDV level of the differential drive signal 306 becomes −1.8V. At time interval $t_5$, the common drive signal 302 transitions to a high voltage level and the pixel drive signal 304 transitions to a low voltage level, thereby causing the differential drive signal 306 to transition from a DDV level of −1.8V to +1.8V. It should be noted that liquid crystal materials that are typically used with microdisplays, such as nematic liquid crystals, are sensitive to the RMS (root mean square) value of the electric field. Hence, the direction of sign of the applied voltage is immaterial as the RMS value of the electric field is independent of the direction of the voltage. Therefore, the DDV levels of −1.8V and +1.8V produce the same electro-optical response in the electro-optical element. At time interval $t_6$, the common drive signal 302 and pixel drive signal 304 result in a DDV level of the differential drive signal 306 of −1.8V.

It should be understood that the differential drive signal 306 is DC balanced so that no DC bias is applied to the liquid crystal electro-optical element, thus minimizing the risk of damage. As understood in the art, to avoid damage to a liquid crystal electro-optical element, the average value of the electric field imposed on a liquid crystal electro-optical element should be zero.

Figure 4:
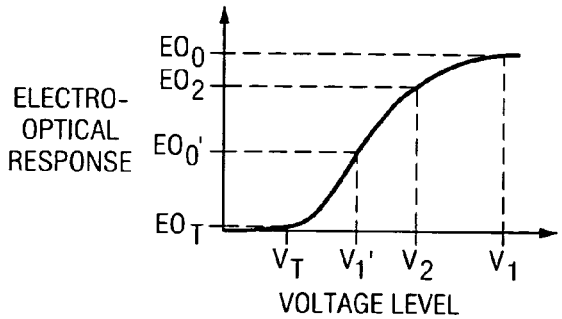
FIG. 4 are interrelated graphs of a conventional technique for driving an electro-optical display device.

FIG. 4 is a graph of an exemplary electro-optical response curve 400 of an electro-optical element. The graph plots the net electro-optical response of the liquid crystal material against the applied voltage. As shown on the graph, voltages $V_1$, $V_1'$, $V_2$ and $V_T$ are DDVs corresponding to the net voltage applied across the electro-optical element between the common electrode and the pixel electrode. As can be seen in FIG. 4, to a first order, the electro-optical response (EO response) of the liquid crystal material is proportional to the DDV. As known in the art, higher EO responses produce higher display contrasts in electro-optical display devices.

In FIG. 4, $V_1$ represents the DDV produced using an external, high voltage differential drive circuit. Applying DDV $V_1$ to an electro-optical element causes the liquid crystal material to produce an EO response of $EO_0$. For conventional external drive circuits, DDV $V_1$ is typically 3.3 V or higher. However, display devices (e.g., LCOS microdisplays) that use internal drive circuits with feature sizes of 180 nm or smaller typically produce a DDV of $V_1'$, which corresponds to the maximum DDV that the internal drive circuit can produce and sustain (i.e., the breakdown voltage). The DDV $V_1'$, which can be, for example, 1.8 V, causes the liquid crystal material to produce an EO response of $EO_0'$. The EO response $EO_0'$ generally produces an inadequate display contrast for many practical applications.

To produce a greater effective DDV from the low voltage internal drive circuits typical of modern liquid crystal devices (e.g., LCOS microdisplays), in accordance with embodiment of the present invention, a DDV $V_2$ is used to produce an electro-optic response $EO_2$ from the electro-optical element. The DDV $V_2$ is produced using a common drive circuit that generates an asymmetrical common drive signal. For example, the common drive signal can be asymmetrically bipolar with respect to a low voltage level of the pixel drive signal to create an effectively larger DDV $V_2$. The EO response of $EO_2$ produced by DDV $V_2$ represents a significantly increased EO response as shown by the EO response curve 400 than the EO response of $EO_0'$, and therefore results in a better display contrast from the electro-optical element.

In one embodiment, the voltage level $V_2$ is produced by summing a DDV less than or equal to a threshold DDV $V_T$ and DDV $V_1'$. With substantially all liquid crystal materials, a threshold DDV $V_T$ is needed to produce an EO response $EO_T$ in the liquid crystal material. Below the threshold DDV $V_T$, the EO response is effectively the same as if no electric field were applied to the liquid crystal material. For example, in one embodiment, a common drive signal formed from a combination (e.g., the sum) of the voltage level corresponding to the threshold DDV $V_T$ and the voltage level corresponding to the DDV $V_1'$ is applied to the common electrode of the liquid crystal electro-optical element and a pixel drive signal substantially equivalent to 0V is applied to the pixel electrode of the liquid crystal electro-optical element to produce the DDV $V_2$.

Figure 5A:
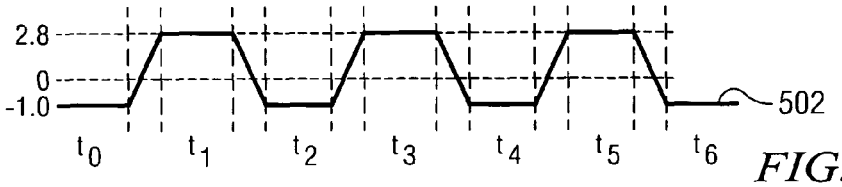
FIGS. 5A-5C are interrelated graphs of a drive technique in accordance with embodiments of the present invention.
Figure 5B:
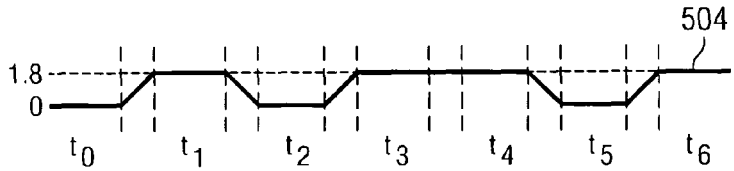
Figure 5C:
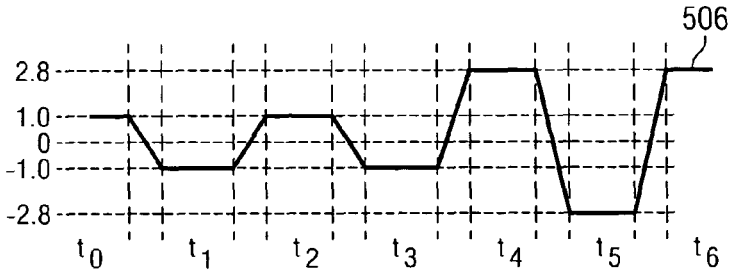

FIGS. 5A-5C are interrelated graphs illustrating a drive method in accordance with embodiments of the present invention for driving an electro-optical element, such as that shown in FIG. 2, to provide for higher levels of display contrast than provided by the drive method of FIGS. 3A-3C. FIG. 5A shows a common drive signal 502 that is substantially periodic and ranges from a low voltage level of −1.0V to a high voltage level of 2.8V. The low voltage level of the common drive signal 502 corresponds to the negative of the voltage level of the threshold DDV $V_T$ (e.g., 1.0V). As discussed with respect to FIG. 4, the voltage level of 1.0V is approximately at or below the threshold voltage $V_T$, so that there is minimal or no electro-optical response of the electro-optical element at the low voltage level of the common drive signal 502. The high voltage level of the common drive signal 502 corresponds to a combination of the voltage level of the threshold DDV $V_T$ and the high voltage level of the common drive signal 302 (shown in FIG. 3). Thus, the common drive signal 502 is an asymmetrical drive signal about the 0V voltage level.

The pixel drive signal 504 in FIG. 5B is the same as that shown in FIG. 3B. Since the pixel drive circuit is typically an internal drive circuit located under the pixel electrode, the voltage limitations resulting from the small feature sizes apply, and the pixel drive signal 504 is limited to the maximum sustainable voltage (e.g., 1.8 V). However, the common drive circuit can be located external to the substrate containing the electro-optical elements or at an edge of the substrate. Therefore, larger transistors capable of producing and sustaining larger voltages can be used in the common drive circuit. Examples of common drive circuit configurations are shown in FIGS. 6 and 7, and discussed in more detail below.

FIG. 5C shows the differential drive signal 506 created by the DDV between the common drive signal 502 and pixel drive signal 504. As shown, at time intervals $t_0$-$t_3$, the level of the differential drive signal 506 is −1.0V or +1.0V due to the common drive signal 502 and the pixel drive signal 504 being in phase and both at either their respective low voltage levels or their respective high voltage levels. As discussed above, the voltage level of 1.0V is approximately at or below the threshold voltage $V_T$, so the differential drive signal 506 at time intervals $t_0$-$t_3$ produces a negligible electro-optical response of the electro-optical element.

At time interval $t_4$, the differential drive signal 506 exhibits the maximum difference between the common drive signal 502 and the pixel drive signal 504 of 2.8V as a result of the pixel drive signal being at the high voltage level and the common drive signal being at the low voltage level. The maximum DDV level is 1.0V higher than that produced with the common drive signal 302 of FIGS. 3A-3C. Similarly, at time interval $t_5$, the differential drive signal 506 is −2.8V. The higher peak to peak value of the differential drive signal 506 results in an RMS value that produces a larger electro-optical response in the liquid crystal material of the electro-optical element, thereby producing increased display contrast of the electro-optical element, as well as faster response time. It should be understood that in implementation, the differential drive signal 506 is DC balanced so that no DC bias is applied to the liquid crystal electro-optical element, thus minimizing the risk of damage.

Figure 6:
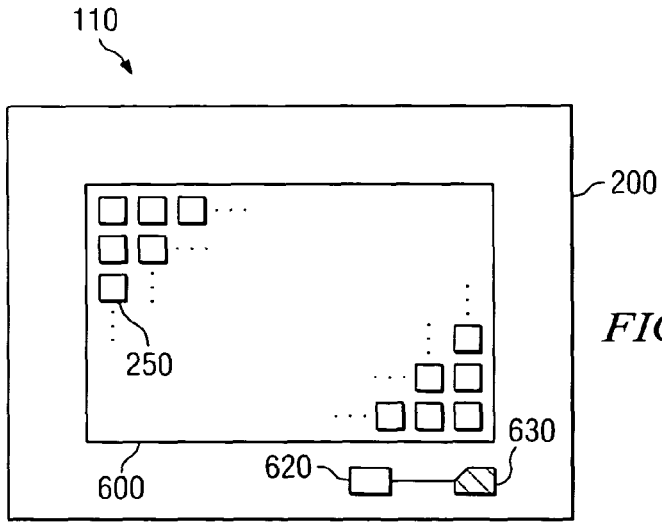
FIG. 6 is a top view of an exemplary display for driving electro-optical elements utilizing the drive technique of FIGS. 5A-5C.
Figure 7:
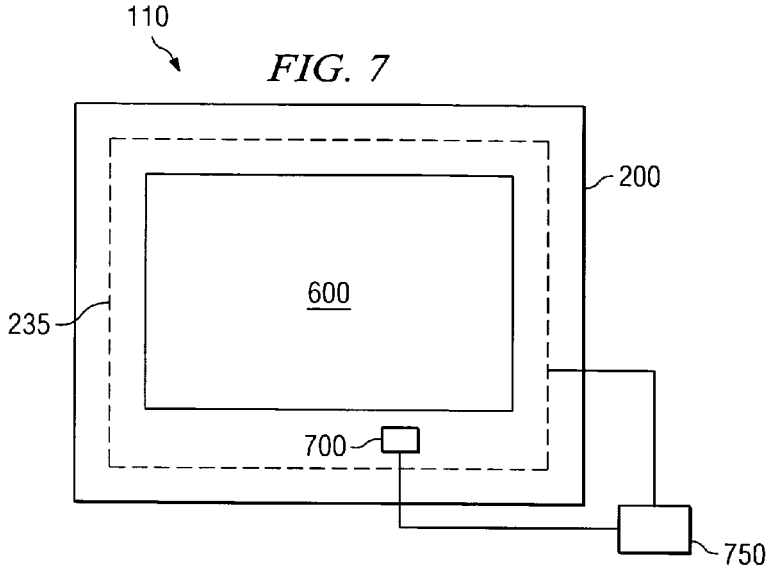
FIG. 7 is a top view of another exemplary display for driving electro-optical elements utilizing the drive technique of FIGS. 5A-5C.

FIG. 6 is a block diagram of an exemplary electro-optical display device 110 including pixel drive circuits 250 and a common drive circuit 620 for driving electro-optical elements utilizing the drive method of FIGS. 5A-5C. As shown, pixel drive circuits 250 used to drive pixel electrodes (215, shown in FIGS. 1 and 2) of respective electro-optical elements are included within a display area 600 of the substrate 200. As discussed above in connection with FIGS. 1 and 2, the pixel drive circuits 250 underlie respective pixel electrodes and provide respective pixel drive signals to the pixel electrodes. In one embodiment, as shown in FIG. 6, a common drive circuit 620 is also included on the substrate 200 outside of the display area 600 to provide the common drive signal to the common electrode (235, shown in FIGS. 1 and 2) of the electro-optical element via contact pad 630. The contact pad 630 provides an electrical connection between the common electrode and the common drive circuit 620 located on the substrate 200.

Most modern IC processes have larger transistors currently available that are capable of withstanding higher voltages (e.g., greater than 1.8V). Although the use of such high-voltage transistors is typically precluded in the context of internally driving the pixel electrode, with only one common electrode for all of the pixel electrodes within an electro-optical display device, the common drive circuit 620 can be constructed using high-voltage transistors to produce the higher common drive voltages with minimal impact to the overall circuit size.

In another embodiment, as shown in FIG. 7, a common drive circuit 750 is located external to the substrate 200 containing the display area 600. The common drive circuit 750 provides the common drive signal to the common electrode 235 overlying the display area 600 of the substrate 200 via an external connection. An example of an external connection to a common drive circuit 750 is described in co-pending and commonly assigned U.S. patent application Ser. No. 09/379,373, which is incorporated herein by reference.

A timing circuit 700 on the substrate 200 provides timing signals to the common drive circuit 750 to control the timing of the common drive signal and to synchronize the common drive circuit 750 with the pixel drive circuits (250, shown in FIG. 6). The timing signals can be clock signals or other types of control signals. For example, the timing signals can be substantially periodic and range from the low voltage level of the pixel drive circuits to the high voltage level of the pixel drive circuits. The common drive circuit 750 can convert the low voltage level of the pixel drive circuits to the low voltage level of the common drive circuit and the high voltage level of the pixel drive circuits to the high voltage level of the common drive circuit. In one embodiment, the common drive circuit 750 can take as input a voltage level of 0 V and convert this voltage level to a voltage level of −1.0 V and take as input a voltage level of 1.8 V and convert this voltage level to a voltage level of 2.8 V. Since there is only a single common electrode for all of the individual pixel electrodes, an external common drive circuit 750 for generating the common drive signal can be easily added with minimal impact to the size of the display device 110. It should be understood that other drive circuit configurations can be utilized to produce the drive signals and be consistent with embodiments of the present invention.

Figure 8:
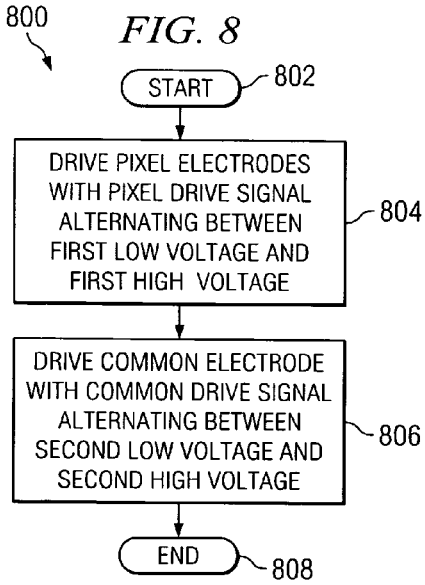
FIG. 8 is a flow diagram of an exemplary process for driving an electro-optical display device in accordance with embodiments of the present invention.

FIG. 8 is a flow diagram 800 of an exemplary process for driving an electro-optical display device to produce increased display contrast. The drive process starts at block 802. At block 804, the pixel electrodes are driven with a pixel drive signal that alternates between a first low voltage and a first high voltage differing in voltage by less than or equal to a process-limited maximum (e.g., 1.8 V). For example, the pixel drive signal at each electro-optical element can alternate between 0 V and 1.8 V. At block 806, the common electrode is driven with a common drive signal that alternates between a second low voltage and a second high voltage. The common drive signal can be substantially periodic and asymmetrically bipolar with respect to the first voltage of the pixel drive signal. For example, the common drive signal can alternate between −1.0 V and 2.8 V. The voltage difference between the first low voltage of the pixel drive signal and the second low voltage of the common drive signal can be approximately at or below the threshold voltage $V_T$, and likewise for the voltage difference between the first high voltage of the pixel drive signal and the second high voltage of the common drive signal.

When the pixel drive signal is applied to one of the pixel electrodes and the common drive signal is applied in antiphase to the common electrode, a high differential drive voltage having a higher differential voltage level than conventional drive techniques (as discussed with respect to FIG. 3) is generated to create a higher display contrast than possible using the conventional drive techniques. When the pixel drive signal and common drive signal are applied in phase to the pixel electrode and common electrode, respectively, a low differential drive voltage having a differential voltage level at or below the threshold voltage level is generated, thereby creating a negligible electro-optical response. By varying phase relations between the common drive signal and the pixel drive signal, a differential drive voltage having a differential voltage level varying between the levels of the low differential drive voltage and high differential drive voltage is generated. The drive process ends at block 808.

Figure 9:
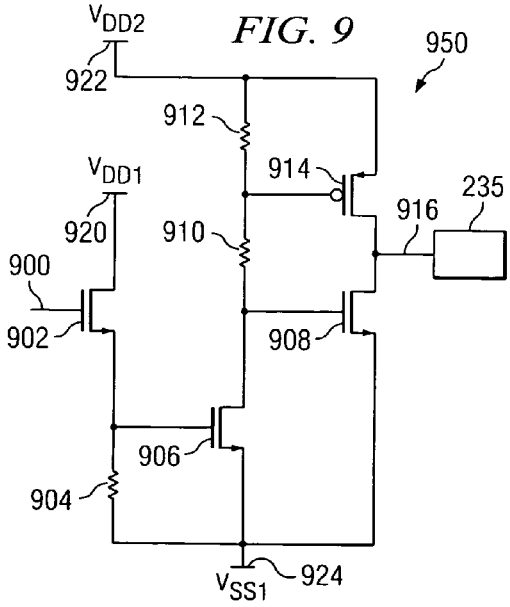
FIG. 9 is a circuit schematic illustrating an exemplary common drive circuit in accordance with embodiments of the present invention.

FIG. 9 is an exemplary circuit schematic of a common drive circuit 950 that can be used to implement the common drive circuit 620 described above in connection with FIG. 6 or the common drive circuit 750 described above in connection with FIG. 7. The common drive circuit 950 is composed of N-type MOS (NMOS) transistors 902, 906 and 908 and P-type MOS (PMOS) transistor 914. A common electrode clock signal 900 is input to the gate of NMOS transistor 902. The drain of NMOS transistor 902 is connected to a supply voltage ($V_{DD1}$) 920 equal to the first high voltage (e.g., 1.8V). The source of NMOS transistor 902 is connected to resistor 904 and the gate of NMOS transistor 906. The drain of NMOS transistor 906 is connected to resistor 910 and the gate of NMOS transistor 908. Resistor 904 is connected to the sources of NMOS transistors 906 and 908, and the sources of NMOS transistors 906 and 908 and resistor 904 are all connected to a supply voltage ($V_{SS1}$) 924 equal to the second low voltage (e.g., −1.0V). The source of PMOS transistor 914 is connected to a supply voltage ($V_{DD2}$) 922 equal to the second high voltage (e.g., 2.8V). The gate of PMOS transistor 914 is connected to one end of resistor 912. The other end of resistor 912 is connected to the supply voltage ($V_{DD2}$) 922. The drains of NMOS transistor 908 and PMOS transistor 914 are connected to an output 916 to the ITO layer 235 forming the common electrode.

When the common electrode clock signal 900 goes high, NMOS transistor 906 turns on, which turns NMOS transistor 908 off and PMOS transistor 914 on, and PMOS transistor 914 pulls the output 916 up to a voltage equal to the second high voltage (e.g., 2.8V). When the common electrode clock signal 900 goes low, NMOS transistor 906 turns off, PMOS transistor 914 turns off and NMOS transistor 908 turns on, and NMOS transistor 908 pulls the output 916 down to a voltage equal to the second low voltage (e.g., −1.0V). It should be understood that suitable alternative circuits can be used in place of the circuit shown in FIG. 9.

It should further be understood that although this invention has been discussed in the context of a nematic liquid crystal material, the drive method of the present invention is applicable to other types of materials that have an offset in their electro-optical response curve, such as organic LEDs and other variants of liquid crystal electro-optical elements.

The innovative concepts described in the present application can be modified and varied over a wide rage of applications. Accordingly, the scope of patents subject matter should not be limited to any of the specific exemplary teachings discussed, but is instead defined by the following claims.

We claim:

1. A drive circuit for driving a display device comprising electro-optical material disposed between a common electrode and an array of pixel electrodes, said drive circuit comprising:

pixel drive circuits connected to respective ones of the pixel electrodes and operable to generate respective pixel drive signals alternating between a first high voltage and a first low voltage differing in voltage by less than or equal to a process-limited maximum; and a common drive circuit connected to the common electrode and operable to generate a common drive signal alternating between a second high voltage and a second low voltage differing in voltage by more than the process-limited maximum, the common drive signal being asymmetrically bipolar with respect to the first low voltage, wherein the first low voltage and the second low voltage differ in voltage by less than or equal to a threshold voltage at which an electro-optical response is produced by the electro-optical material.

2. The drive circuit of claim 1, wherein the first high voltage and the second high voltage differ in voltage by less than or equal to the threshold voltage.

3. The drive circuit of claim 1, wherein the common drive signal is substantially periodic between the second low voltage and the second high voltage.

4. The drive circuit of claim 1, wherein said pixel drive circuits are located on a substrate of the display device including the array of pixel electrodes, said pixel drive circuits underlying respective ones of the pixel electrodes.

5. The drive circuit of claim 4, wherein said common drive circuit is located on the substrate.

6. The drive circuit of claim 4, wherein said common drive circuit is located external to the substrate.

7. The drive circuit of claim 6, wherein the substrate includes a timing circuit connected to said common drive circuit to control the timing of the common drive signal.

8. The drive circuit of claim 7, wherein the timing circuit alternates between the first low voltage and the first high voltage, said common drive circuit converting the first low voltage to the second low voltage and the first high voltage to the second high voltage.

9. The drive circuit of claim 4, wherein the process-limited maximum is the breakdown voltage of said pixel drive circuits.

10. The drive circuit of claim 1, wherein at least one of said pixel drive circuits and said common drive circuit is further operable to vary a phase relationship between the respective pixel drive signals and the common drive signal.

11. A drive circuit for driving a display device comprising electro-optical material disposed between a common electrode and an array of pixel electrodes, said drive circuit comprising:

pixel drive circuits connected to respective ones of the pixel electrodes and operable to generate respective pixel drive signals alternating between a first high voltage and a first low voltage differing in voltage by less than or equal to a process-limited maximum; and a common drive circuit connected to the common electrode and operable to generate a common drive signal alternating between a second high voltage and a second low voltage differing in voltage by more than the process-limited maximum, the common drive signal being asymmetrically bipolar with respect to the first low voltage, wherein the first low voltage and the second low voltage differ in voltage by less than or equal to a threshold voltage at which an electro-optical response is produced by the electro-optical material, wherein at least one of said pixel drive circuits and said common drive circuit is further operable to vary the phase relationship between the respective pixel drive signals and the common drive signals, wherein the process-limited maximum is less than or equal to 1.8 volts.

12. A method for driving a display device comprising electro-optical material disposed between a common electrode and an array of pixel electrodes, said method comprising:

driving each of the pixel electrodes with a respective pixel drive signal alternating between a first high voltage and a first low voltage differing in voltage by less than or equal to a process-limited maximum; and driving the common electrode with a common drive signal alternating between a second high voltage and a second low voltage differing in voltage by more than the process-limited maximum, the common drive signal being asymmetrically bipolar with respect to the first low voltage; determining a threshold voltage at which an electro-optical response is produced by the electro-optical material; and setting the first low voltage and the second low voltage to differ in voltage by less than or equal to the threshold voltage and the first high voltage and the second high voltage to differ in voltage by less than or equal to the threshold voltage.

13. The method of claim 12, wherein said driving the common electrode includes generating the common drive signal substantially periodic between the second low voltage and the second high voltage.

14. The method of claim 12, wherein said driving the common electrode includes generating the common drive signal on a substrate of the display device, the substrate including the array of pixel electrodes.

15. The method of claim 12, wherein said driving the common electrode further includes generating the common drive signal external to a substrate of the display device, the substrate including the array of pixel electrodes.

16. The method of claim 15, wherein said generating the common drive signal further includes generating a timing signal on the substrate to control a timing of the common drive signal.

17. The method of claim 16, wherein said generating the timing signal further includes alternating the timing signal between the first low voltage and the first high voltage, said driving the common electrode further comprising converting the first low voltage to the second low voltage and the first high voltage to the second high voltage.

18. The method of claim 12, further comprising:

varying phase relations between the respective pixel drive signals and the common drive signal.

* * * * *